US006921511B2

(12) United States Patent
Bourgin et al.

(10) Patent No.: US 6,921,511 B2
(45) **Date of Patent: *Jul. 26, 2005**

(54) SULPHUR-CONTAINING FERRITIC STAINLESS STEEL THAT CAN BE USED FOR FERROMAGNETIC PARTS

(75) Inventors: Christophe Bourgin, Albertville (FR); Daniele Cereda, Peschiera Borromeo (IT); Marie-Claude Orlandi, Ugine (FR); Benoît Pollet, Ugine (FR); Bernard Tetu, Saint Vital (FR); Christian Trombert, Ugine (FR); Corinne Viguet-Carrin, Usine (FR)

(73) Assignee: UGITECH, Ugine (FR)

( * ) Notice: Subject to any disclaimer, the term of this patent is extended or adjusted under 35 U.S.C. 154(b) by 125 days.

This patent is subject to a terminal disclaimer.

(21) Appl. No.: 10/303,000

(22) Filed: Nov. 25, 2002

(65) Prior Publication Data

US 2003/0121575 A1 Jul. 3, 2003

(30) Foreign Application Priority Data

Nov. 26, 2001 (FR) ..... 01 15240

(51) Int. Cl.[7] ..... C22C 38/18
(52) U.S. Cl. ..... 420/41; 420/42; 148/326
(58) Field of Search ..... 420/41, 42; 148/326

(56) References Cited

U.S. PATENT DOCUMENTS 3,902,898 A * 9/1975 Denhard, Jr. et al. ..... 75/28 P
3,928,088 A * 12/1975 Schlosser et al. ..... 148/37

(Continued)

FOREIGN PATENT DOCUMENTS

EP 629 714 A1 12/1994
EP 773306 A1 5/1997
EP 1130127 A1 9/2001
FR 2720410 A1 12/1995

OTHER PUBLICATIONS

English language Abstract & JP 11 172369 (Kawasaki Steel Corp), Jun. 29, 1999.

(Continued)

*Primary Examiner*—Daniel Jenkins
(74) *Attorney, Agent, or Firm*—Sughrue Mion, PLLC

(57) ABSTRACT

Ferritic stainless steel that can be used for ferromagnetic parts, characterized in that it comprises in its composition by weight:

$C \leqq 0.030\%$
$1.0\% < Si \leqq 3\%$
$0.1\% < Mn \leqq 0.5\%$
$10\% \leqq Cr \leqq 13\%$
$0\% < Ni < 1\%$
$0.03\% < S < 0.5\%$
$0\% < P \leqq 0.030\%$
$0.2\% < Mo \leqq 2\%$
$0\% < Cu \leqq 0.5\%$
$0\% < N \leqq 0.030\%$
$0\% < Ti \leqq 0.5\%$
$0\% < Nb \leqq 1\%$
$0\% < Al \leqq 100\times10^{-4}\%$
$30\times10^{-4}\% < Ca \leqq 100\times10^{-4}\%$
$50\times10^{-4}\% < O \leqq 150\times10^{-4}\%$ the ratio of the calcium content to the oxygen content Ca/O being $0.3 \leqq Ca/O \leqq 1$, the balance being ion and the inevitable impurities from the smelting of the steel, and a process for manufacturing ferromagnetic parts.

9 Claims, 1 Drawing Sheet

U.S. PATENT DOCUMENTS

| | | | | | |
|---|---|---|---|---|---|
| 4,340,428 | A | * | 7/1982 | Boddeker et al. | 106/122 |
| 4,711,677 | A | * | 12/1987 | Mendelson | 148/325 |
| 5,496,515 | A | * | 3/1996 | Pedarre et al. | 420/41 |
| 5,769,974 | A | | 6/1998 | Masteller et al. | |
| 5,788,922 | A | * | 8/1998 | Magee, Jr. | 420/42 |
| 6,146,475 | A | * | 11/2000 | Kosa | 148/325 |

OTHER PUBLICATIONS

Patent Abstracts of Japan, vol. 2000, No. 09, Oct. 13, 2000, & JP 2000 169944 (Sanyo Special Steel Co., Ltd.), Jun. 20, 2000.

Patent Abstracts of Japan, vol. 2000, No. 16, May 8, 2001 & JP 2001 011581 (Sanyo Special Steel Co., Ltd.), Jan. 16, 2001.

Patent Abstracts of Japan, vol. 018, No. 468, Aug. 31, 1994 & JP 06 145908 (Daido Steel Co., Ltd.).

* cited by examiner

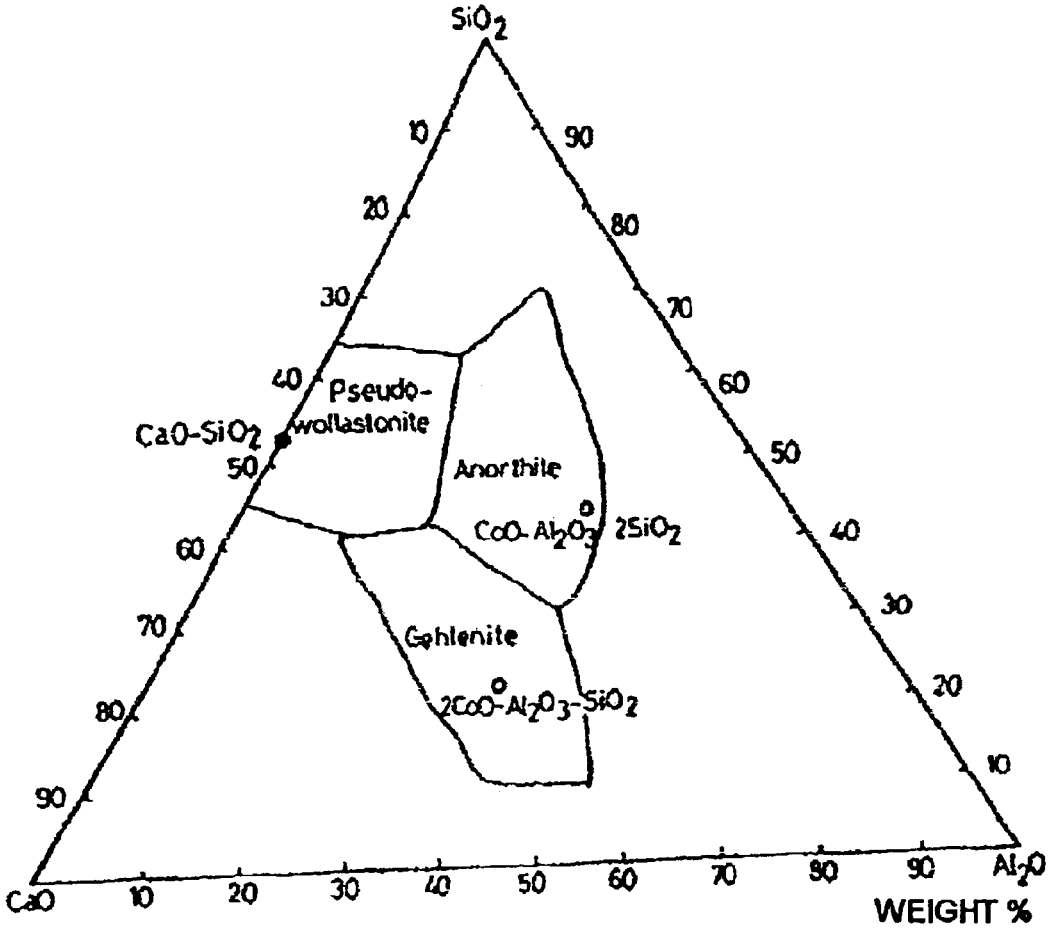
SiO2
10
20
30
40
50
60
70
80
90
90
80
70
60
50
40
30
20
10
Pseudo-
wollastonite
CaO-SiO2
Anorthite
CaO-Al2O3-2SiO2
Gehlenite
2CaO-Al2O3-SiO2
CaO
10
20
30
40
50
60
70
80
90
Al2O
WEIGHT %

SULPHUR-CONTAINING FERRITIC STAINLESS STEEL THAT CAN BE USED FOR FERROMAGNETIC PARTS

BACKGROUND OF THE INVENTION

The present invention relates to a sulphur-containing ferritic stainless steel that can be used for ferromagnetic parts.

Ferritic stainless steels are characterized by a defined composition, the ferritic structure being in particular ensured, after the composition has been rolled and cooled, by an annealing heat treatment giving them the said structure.

Among the broad families of ferritic stainless steels, defined in particular according to their chromium and carbon contents we mention:

- ferritic stainless steels that may contain up to 0.17% carbon. These steels, after the cooling that follows their smelting, have an austenoferritic two-phase structure. However, they may be transformed to ferritic stainless steels after annealing, despite a high carbon content;
- ferritic stainless steels whose chromium content is around 11 or 12%. They are quite similar to martensitic steels containing 12% chromium, but differ in their carbon content which is relatively low.

When steel is hot-rolled, the steel may have a two-phase—ferritic and austenitic—structure. If the cooling is vigorous, for example, the final structure is ferritic and martensitic. If the cooling is slower, the austenite partially decomposes into ferrite and carbides, but with a carbon content richer than the surrounding matrix, the austenite,, when hot, having dissolved more carbon than the ferrite. In both cases, a tempering or annealing operation must therefore be carried out on the hot-rolled and cooled steels in order to generate a completely ferritic structure. The tempering may be performed at a temperature of about 820° C., below the alpha→gamma temperature Ac1, thereby precipitating carbides.

In the field of ferritic steels intended for applications utilizing the magnetic properties, the ferritic structure is obtained by limiting the amount of carbides, and it is for this reason that the ferritic stainless steels developed in this field have a carbon content of less than 0.03%.

Steels that can be utilized for their magnetic properties are known, such as for example those in the document U.S. Pat. No. 5,769,974 which discloses a process for manufacturing a corrosion-resistant ferritic steel and able to reduce the value of the coercive field of the said steel. The compositional ranges presented are very broad and do not define a range for optimizing the properties needed for applications for ferromagnetic parts. The steel used in the process is a steel of the resulphurized type. However, the steel obtained by the process, which contains sulphur, is sensitive to corrosion.

Also known is the patent U.S. Pat. No. 5,091,024 which discloses corrosion-resistant magnetic articles formed from an alloy essentially consisting of a composition having a low carbon content and a low silicon content, that is to say less than 0.03% and 0.5% respectively. However, in the magnetic field, it is important that the steel contains a high silicon content in order to increase the resistivity of the material and reduce eddy currents.

Also known is the French patent application No. 94/06590 (now French Patent No. 2,720,410, corresponding to U.S. Pat. No. 5,496,515), which relates to a ferritic steel with improved machinability for applications in the machining field, but the compositional ranges presented are very broad and do not define a range for optimizing the properties necessary for ferromagnetic parts.

SUMMARY OF THE INVENTION

The object of the present invention is to present a sulphur-containing stainless steel of ferritic structure that can be used for magnetic parts having high magnetic properties and exhibiting very good machinability and corrosion resistance properties.

The subject of the invention is a sulphur-containing ferritic stainless steel that can be used for ferromagnetic parts, which is characterized in that it comprises in its composition by weight:

$C \leqq 0.030\%$ $1.0\% < Si \leqq 3\%$ $0.1\% < Mn \leqq 0.5\%$ $10\% \leqq Cr \leqq 13\%$ $0\% < Ni < 1\%$ $0.03\% < S < 0.5\%$ $0\% < P \leqq 0.030\%$ $0.2\% < Mo \leqq 2\%$ $0\% < Cu \leqq 0.5\%$ $0\% < N \leqq 0.030\%$ $0\% < Ti \leqq 0.5\%$ $0\% < Nb \leqq 1\%$ $0\% < Al \leqq 100 \times 10^{-4}\%$ $30 \times 10^{-4}\% < Ca \leqq 100 \times 10^{-4}\%$ $50 \times 10^{-4}\% < O \leqq 150 \times 10^{-4}\%$ the ratio of the calcium content to the oxygen content Ca/O being $0.3 \leqq Ca/O \leqq 1$, the balance being iron and the inevitable impurities from the smelting of the steel.

The other features of the invention are:

- the steel contains lime aluminosilicate inclusions of the anorthite and/or pseudowollastonite and/or gehlenite type, associated with inclusions of the chromium and manganese sulphide type;
- preferably, the steel has in its composition by weight a silicon content of between 1.5% and 2%;
- preferably, the steel has in its composition by weight a chromium content of between 11.8% and 13%;
- preferably, the steel has in its composition by weight a sulphur content of between 0.10% and 0.5%; more particularly preferably between 0.10 and 0.30%;
- preferably, the steel has in its composition by weight a molybdenum content of between 0.4% and 1%; and
- preferably, the steel has in its composition by weight a manganese content of less than or equal to 0.3%.

The invention also relates to a process for manufacturing a part formed from a ferritic steel whose composition by weight is in accordance with the invention and may undergo, after hot rolling and cooling, an operation to modify the cross section, of the drawing or wire-drawing type, either after an optional annealing heat treatment or without an annealing heat treatment.

The drawn or wire-drawn steel may subsequently undergo a supplementary recrystallization step to perfect the magnetic properties of the part.

The description that follows and the single FIGURE given solely by way of non-limiting example, will make the invention clearly understood.

BRIEF DESCRIPTION OF THE DRAWING

The single FIGURE shows a ternary diagram giving the general composition of the lime aluminosilicate inclusions.

DETAILED DESCRIPTION OF THE INVENTION

The invention relates to a steel of the following general composition:

$C \leqq 0.030\%$ $1.0\% < Si \leqq 3\%$ $0.1\% < Mn \leqq 0.5\%$ $10\% \leqq Cr \leqq 13\%$ $0\% < Ni < 1\%$ $0.03\% < S < 0.5\%$ $0\% < P \leqq 0.030\%$ $0.2\% < Mo \leqq 2\%$ $0\% < N \leqq 0.030\%$ $0\% < Ti \leqq 0.5\%$ $0\% < Nb \leqq 1\%$ $0\% < Al \leqq 100 \times 10^{-4}\%$ $30 \times 10^{-4}\% < Ca \leqq 100 \times 10^{-4}\%$ $50 \times 10^{-4}\% < O \leqq 150 \times 10^{-4}\%$ the balance being iron and the inevitable impurities during smelting of the steel.

The compositions thus defined with tight ranges make it possible to obtain the properties necessary for applications for ferromagnetic parts.

From the metallurgical standpoint, certain elements contained in the composition of a steel favour the appearance of a ferritic phase of body-centred cubic structure. These elements are referred to as alpha-inducing elements. These include in particular chromium and molybdenum. Other elements, called gamma-inducing elements, favour the appearance of the gamma-austenitic phase of face-centred cubic structure. Included in these elements are nickel, carbon and nitrogen. It is therefore necessary to reduce the content of these elements, and it is for these reasons that the steel according to the invention has in its composition less than 0.030% carbon, less than 1% nickel and less than 0.030% nitrogen.

Carbon is detrimental to corrosion and to machinability. In general, the precipitates must be small since they constitute, from the magnetic properties standpoint, an obstacle to movements of the Bloch walls.

As regards the other elements of the composition, nickel and manganese, due to industrial-scale smelting of the steel, are only residual elements that it is desired to reduce and even to eliminate.

Titanium and/or niobium form/forms compounds, including titanium carbide and/or niobium carbide, thereby preventing the formation of chromium carbide and nitride. They consequently favour corrosion resistance and especially the corrosion resistance of welds, when a weld is needed to produce a magnetic part.

Sulphur in the form of sulphides favours chip fragmentation and improves the lifetime of the machining tools. However, in the form of manganese sulphide it degrades the corrosion resistance properties. Introduced in the form of chromium-manganese sulphide, with chromium predominating, the favourable action on machinability is preserved and the unfavourable effect on corrosion resistance is greatly reduced.

Silicon is needed to increase the resistivity of the steel, so as to reduce eddy currents, and is favourable for corrosion resistance. A content of greater than 1.5% is preferable.

The steels according to the invention may also contain from 0.2% to 2% molybdenum, this element improving the corrosion resistance and favouring the formation of ferrite.

In the field in which they are used, ferritic stainless steels pose machinability problems.

This is because a major drawback with ferritic steels is the poor shape of the chip. They produce long and entangled chips, which are very difficult to fragment. This drawback may become highly penalizing in modes of machining in which the chip is confined, such as for example in deep drilling or in parting off.

According to the invention, one solution for alleviating the problems related to machining of ferritic steels is to introduce sulphur into their composition. According to the invention, the sulphur-containing ferritic stainless steel furthermore contains, in its composition by weight, at most $30 \times 10^{-4}\%$ calcium and at most $50 \times 10^{-4}\%$ oxygen.

The introduction in a controlled and intentional manner of calcium and oxygen satisfying the relationship $0.3 \leqq Ca/O \leqq 1$ favours, in the ferritic steel, the formation of malleable oxides of the lime aluminosilicate type as shown in FIG. 1 which is an $Al_2O_3/SiO_2/CaO$ ternary diagram, the malleable oxides being chosen within the region of the anorthite-gehlenite-pseudowollastonite triple point.

The presence of calcium and oxygen limits the formation of hard abrasive inclusions of the chromite, alumina or silicate type. On the other hand, the presence in the steel according to the invention of lime aluminosilicate inclusions favours chip fragmentation and improves the lifetime of the cutting tools.

It has been found that introducing calcium-based oxides into a steel of ferritic structure, as a replacement of the existing hard oxides, modifies only very slightly the characteristics of the ferritic steel in the magnetic properties field.

The low manganese content favours the formation of manganese-chromium sulphide inclusions in which chromium is the major or predominant component, thereby greatly improving the resistance to pitting corrosion in a chloride medium.

The presence of so-called malleable oxides and sulphides in a ferritic steel also has advantages in the drawing and wire-drawing field.

This is because the malleable inclusions are able to deform in the rolling direction, whereas hard oxides remain in particle form.

In the wire-drawing field, for small-diameter ferritic steel wire, the inclusions chosen according to the invention substantially reduce the extent of breakage of the drawn wire.

In another field of application, for example in polishing operations, the hard inclusions become encrusted in the ferritic steel and cause surface grooves.

The ferritic steel according to the invention, having malleable lime aluminosilicate inclusions associated with manganese-chromium sulphides may be polished much more easily so as to obtain an improved polished surface finish.

The steel may be smelted by electric melting and then continuously cast to form blooms.

The blooms then undergo hot rolling in order to form, for example, wire rod or bars.

Annealing may be carried out in order to ensure the cold-conversion operations carried out on the product, for example drawing and wire drawing, but this is not essential.

The steel may undergo a supplementary recrystallization annealing to restore and perfect the magnetic properties. This is then followed by a surface treatment.

In an application example, three steels according to the invention, denoted steel 1, steel 2 and steel 3, together with four control steels A, B, C and D, were smelted, the compositions of which are given in Table 1 below:

TABLE 1

| % | C | Cr | Si | Mo | Mn | P | N | S | Ni | Cu | Ti | Nb | Ca | O |
|---|---|---|---|---|---|---|---|---|---|---|---|---|---|---|
| Steel 1 | 0.011 | 12.2 | 1.6 | 0.47 | 0.22 | 0.015 | 0.007 | 0.180 | 0.106 | 0.08 | 0.003 | 0.002 | 0.0051 | 0.0067 |
| Steel 2 | 0.009 | 12.5 | 1.7 | 0.55 | 0.23 | 0.014 | 0.008 | 0.210 | 0.088 | 0.05 | 0.002 | 0.002 | 0.0053 | 0.0076 |
| Steel 3 | 0.011 | 12.2 | 1.6 | 0.47 | 0.22 | 0.015 | 0.007 | 0.180 | 0.106 | 0.08 | 0.003 | 0.002 | 0.0051 | 0.0067 |
| Control A | 0.015 | 17.4 | 1.25 | 0.35 | 0.5 | 0.02 | 0.02 | 0.28 | 0.3 | 0.1 | 0.003 | 0.002 | 0.002 | 0.006 |
| Control B | 0.016 | 17.5 | 1.37 | 1.53 | 0.38 | 0.018 | 0.017 | 0.277 | 0.29 | 0.06 | 0.003 | 0.003 | 0.0017 | 0.007 |
| Control C | 0.011 | 11.9 | 1.47 | 0.49 | 0.22 | 0.015 | 0.007 | 0.029 | 0.126 | 0.06 | 0.003 | 0.002 | 0.0062 | 0.0012 |
| Control D | 0.011 | 12.2 | 0.81 | 0.31 | 0.47 | 0.018 | 0.01 | 0.29 | 0.13 | 0.07 | 0.003 | 0.003 | 0.0012 | 0.0052 |

The steels were converted into bars 10 mm in diameter according to the following process:

hot rolling of an 11 mm round;

annealing, except in the case of steel 3, drawing down to a diameter of 10 mm;

final annealing;

straightening and grinding;

they were then characterized in terms of magnetic properties, machinability and corrosion.

Steels 1, 2 and 3 according to the invention have better magnetic properties than the control steels A, B and D, as shown in Table 2 below.

TABLE 2

| Steel | Coercive field $H_c$ (A/m) | Relative permeability $\mu r$ |
|---|---|---|
| Steel 1 | 117 | 2300 |
| Steel 2 | 120 | 2200 |
| Steel 3 | 125 | 2100 |
| Control A | 184 | 1200 |
| Control B | 177 | 1300 |
| Control C | 115 | 2100 |
| Control D | 140 | 1600 |

These properties are due to a low content of addition elements, in particular to a chromium content of about 12%, and to a relatively moderate sulphur content.

Steels 1, 2 and 3 exhibit excellent free-cutting machining behaviour, thanks to the combination of the sulphur content and the presence of lime aluminosilicate inclusions due to the calcium and oxygen contents.

Steels 1, 2 and 3 behave well in the corrosion field, despite their low chromium content, as may be seen in Table 3 below, thanks to their relatively limited sulphur content combined with a low manganese content favouring the presence of chromium-rich sulphides.

TABLE 3

| | Pitting potential in 0.02M NaCl at 23° C. | $I_{corrosion}$ in 2M $H_2SO_4$ at 23° C. |
|---|---|---|
| Steel 1 | 180 mV/SCE | 20 mA/cm$^2$ |
| Steel 2 | 175 mV/SCE | 17 mA/cm$^2$ |
| Steel 3 | 180 mV/SCE | 20 mA/cm$^2$ |
| Control A | 205 mV/SCE | 24 mA/cm$^2$ |
| Control B | 330 mV/SCE | 6 mA/cm$^2$ |
| Control C | 215 mV/SCE | 11 mA/cm$^2$ |
| Control D | 150 mV/SCE | 40 mA/cm$^2$ |

In summary, the steel according to the invention is defined with tight compositional ranges in order to optimize often incompatible properties: excellent magnetism and machining properties, while still exhibiting good behaviour in terms of corrosion by virtue of their relatively low sulphur content, compensated in the case of machineability by their calcium and oxygen content and the presence of lime aluminosilicate inclusions, combined with a low manganese content favouring the presence of chromium-rich sulphides.

The steel according to the invention can be used in particular for the manufacture of ferromagnetic parts such as, for example, solenoid valve parts, injector parts for a direct fuel injection system, centralized door locking parts in the field of motor vehicles, or any application requiring parts of the inductor or magnetic core type. In sheet form, it can be used in current transformers or magnetic screening.

What is claimed is:

1. Ferritic stainless steel for use only in ferromagnetic parts, characterized in that it comprises in its composition by weight:

$C \leqq 0.030\%$ $1.0\% < Si \leqq 3\%$ $0.1\% < Mn \leqq 0.5\%$ $10\% \leqq Cr \leqq 13\%$ $0\% < Ni < 1\%$ $0.03\% < S < 0.5\%$ $0\% < P \leqq 0.030\%$ $0.2\% < Mo \leqq 2\%$ $0\% < Cu \leqq 0.5\%$ $0\% < N \leqq 0.030\%$ $0\% < Ti \leqq 0.5\%$ $0\% < Nb \leqq 1\%$ $0\% < Al \leqq 100 \times 10^{-4}\%$ $30 \times 10^{-4}\% < Ca \leqq 100 \times 10^{-4}\%$ $50 \times 10^{-4}\% < O \leqq 150 \times 10^{-4}\%$ the ratio of the calcium content to the oxygen content Ca/O being $0.3 \leqq Ca/O \leqq 1$, the balance being iron and the inevitable impurities from the smelting of the steel, the steel being further characterized in that the steel contains lime aluminosilicate inclusions of anorthite and/or pseudowollastonite and/or gehlenite, associated with inclusions of chromium and manganese sulphide.

2. Steel according to claim 1, characterized in that it furthermore has in its composition by weight a silicon content of between 1.5% and 2%.

3. Steel according to claim 2, characterized in that it furthermore has in its composition by weight a chromium content of between 11.8% and 13%.

4. Steel according to claim 3, characterized in that it furthermore has in its composition by weight a sulphur content of between 0.10% and 0.5%.

5. Steel according to claim 4, characterized in that it furthermore has in its composition by weight a sulphur content of between 0.10 and 0.3%.

6. Steel according to claim 5, characterized in that it furthermore has in its composition by weight a molybdenum content of between 0.4% and 1%.

7. Steel according to claim 6, characterized in that it furthermore has in its composition by weight a manganese content of less than 0.3%.

8. Process for manufacturing the ferromagnetic part formed from the ferritic steel according to claim 1, characterized in that the steel undergoes, after hot rolling and cooling, an operation to modify the cross section, of the drawing or wire drawing type, either after an annealing heat treatment or without an annealing heat treatment.

9. Process according to claim 8, characterized in that the drawn or wire-drawn steel subsequently undergoes a supplementary recrystallization annealing treatment to perfect the magnetic properties of the said part.

* * * * *